US007242417B2

(12) United States Patent
Nishitani et al.

(10) Patent No.: US 7,242,417 B2
(45) Date of Patent: Jul. 10, 2007

(54) PRINTER AND PRINTING METHOD

(75) Inventors: Hitoshi Nishitani, Ohta-ku (JP); Gen Kitamura, Ohta-ku (JP); Hideki Kawashima, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 234 days.

(21) Appl. No.: 11/085,701

(22) Filed: Mar. 21, 2005

(65) Prior Publication Data

US 2005/0212896 A1 Sep. 29, 2005

(30) Foreign Application Priority Data

Mar. 23, 2004 (JP) ..... 2004-085011
Mar. 4, 2005 (JP) ..... 2005-060650

(51) Int. Cl.
*B41J 2/325* (2006.01)

(52) U.S. Cl. ..... 347/218

(58) Field of Classification Search ..... 347/171–172, 347/177, 218, 221
See application file for complete search history.

(56) References Cited

U.S. PATENT DOCUMENTS 5,305,020 A * 4/1994 Gibbons et al. ..... 347/177
6,652,174 B1 11/2003 Mann et al.
2001/0031161 A1 10/2001 Nakazato
2002/0163569 A1 * 11/2002 Shibuya ..... 347/172

FOREIGN PATENT DOCUMENTS

| | | |
|---|---|---|
| JP | 04-235846 | 8/1992 |
| JP | 05-032349 | 2/1993 |
| JP | 5-32349 A | 2/1993 |
| JP | 5-162899 A | 6/1993 |
| JP | 5-213487 A | 8/1993 |
| JP | 7-68771 A | 3/1995 |
| JP | 07-223756 | 8/1995 |
| JP | 09-040230 | 2/1997 |
| JP | 9-40230 A | 2/1997 |
| JP | 2002-68519 A | 3/2002 |
| JP | 2002-234636 A | 8/2002 |

* cited by examiner

*Primary Examiner*—K. Feggins
(74) *Attorney, Agent, or Firm*—Canon U.S.A. Inc I.P. Div

(57) ABSTRACT

A printer includes a supply member that separates and supplies a recording sheet from a sheet storage means, and a recording-sheet turning member that can turn the recording sheet. A recording sheet supplied from the sheet storage means by the supply member is turned approximately 90 degrees by the recording-sheet turning member, and is then subjected to image formation in an image forming means.

22 Claims, 18 Drawing Sheets

PRINTER AND PRINTING METHOD

BACKGROUND OF THE INVENTION

1. Field of the Invention

The present invention relates to a printer that performs printing on a recording medium, such as a recording sheet, according to image information.

2. Description of the Related Art

In general, printers having the simplest configuration include two units, a sheet storage unit that contains recording sheets, and an image forming unit. Examples of configurations of the printers will be described with reference to FIGS. 16 to 18.

FIGS. 16A, 16B, and 16C are a perspective view, a plan view, and a side view, respectively, of a printer in which a sheet storage unit 11 (a dotted area indicates the largest possible recording sheets on which image formation is possible) is horizontally placed, and is connected at one end to an image forming unit 12. Recording sheets are supplied, fed, subjected to image formation, and ejected in the direction of the arrow in FIG. 15C. In this case, the installation area S of the printer is large, but the height H is small. This printer is disclosed in, for example, Japanese Patent Laid-Open No. 2002-68519.

FIGS. 17A, 17B, and 17C are a perspective view, a plan view, and a side view, respectively, of a printer in which a sheet storage unit 21 (a dotted area indicates the largest possible recording sheets on which image formation is possible) is vertically placed, and is connected at one end to an image forming unit 22. Recording sheets are supplied, fed, subjected to image formation, and ejected in the direction of the arrow in FIG. 17C. In this case, the height H is larger, but the installation area S is smaller than in the printer shown in FIG. 16A to 16C. This printer is disclosed in, for example, Japanese Patent Laid-Open No. 7-68771.

FIGS. 18A, 18B, and 18C are a perspective view, a plan view, and a side view, respectively, of a printer in which a sheet storage unit 31 (a dotted area indicates the largest possible recording sheets on which image formation is possible) is horizontally placed, and an image forming unit 32 is provided thereon. Recording sheets are supplied, fed, subjected to image formation, and ejected in the direction of the arrow in FIG. 18C. In this case, the height H is larger than in the printer shown in FIGS. 16A to 16C, and the installation area S is larger than in the printer shown in FIGS. 17A to 17C. However, the height H and the installation area S are well balanced. This printer is disclosed in, for example, Japanese Patent Laid-Open No. 5-32349.

The first common characteristic of the above three printers is that the largest possible recording sheet on which image formation is possible is conveyed in the longitudinal direction thereof through the image forming means for image formation.

Image forming means of current printers adopt various recording methods such as electrophotography, ink-jet printing, and thermal printing. Regardless of the recording method, side plates serving as structures are provided on both sides of a feeding path in the feeding direction of a recording sheet in the image forming means. Since ends of feeding rollers and ends of element components for image formation are supported by the side plates, the lengths of the feeding rollers and the element components can be reduced by shortening the distance between the side plates. It is obvious that a smaller length of the element components improves various mechanical characteristics, for example, machining accuracy and time, material cost, machining cost, positioning accuracy during assembly, flexure strength, and ease of assembly. It is also obvious that the distance between the side plates needs to be longer than the width of the recording sheet that passes therebetween. For this reason, in most printers, a recording sheet is conveyed in the longitudinal direction thereof so that the direction of its short sides coincides with the width direction of the feeding path. A converse configuration in which the recording sheet is conveyed in the direction of its short sides so that the direction of its long sides coincides with the width direction of the feeding path is also practically used because printing on the entire recording sheet is completed in a period shorter than in the above configuration when the recording speed per unit length is not changed. However, it is more advantageous to improve the mechanical characteristics by reducing the lengths of the element components. Therefore, in the great majority of practical printers, the recording sheet is conveyed in the longitudinal direction thereof so that the direction of its short sides coincides with the width direction of the feeding path in the image forming means.

The second common characteristic of the above three printers is that the longer dimension of the image forming means is larger by at least approximately 10 mm than the shorter dimension of the largest possible recording sheet on which image formation is possible. As described above, side plates serving as structures are provided on both sides in the feeding direction of the feeding path of the image forming means in which the recording sheet passes, the distance between the side plates is longer than the width of the largest possible recording sheet, and the side plates support the ends of the feeding rollers and the element components for image formation. Outside the side plates, there are provided components that cannot be placed in a region, through which the recording sheet passes during printing, in terms of design and components that may be placed in the region, but should be placed outside the region if possible. The components that cannot be placed in a region, through which the recording sheet passes during printing, in terms of design are, for example, mechanical components such as gears for driving rollers, and fixed components such as bearings. Since these components must input driving force to the rollers for feeding the recording sheet without interfering with the fed recording sheet, they cannot be placed in the region. The components that may be placed in the region, but should be placed outside the region if possible are, for example, electrical components such as motors, power boards, and control boards. Since these components include large parts such as motor cases and electrolytic capacitors, when they are placed in the region, the height of the printer increases. Therefore, these components should be placed outside the region if possible. Furthermore, since the stability of operation of wires that are easily affected by electrical noise, such as signal lines for a thermal head, increases as the length of the wires decreases, it is usual to place control boards on both sides in order to reduce the lengths of the wires. As described above, reasonable dimensions are necessary outside the side plates. The longer dimension of the image forming means is determined with reference to the upper limit of the outside dimension, for example, the dimension of the motor serving as a rotating source for the rollers, and, in general, is larger by at least approximately 10 mm than the width of the largest possible recording sheet on which image formation is possible.

SUMMARY OF THE INVENTION

The present invention provides a printer having reduced installation area and height.

A printer of the present invention includes a sheet turning member that turns a recording sheet around a line parallel to the normal direction of the recording sheet. A recording sheet separated and delivered by a supply member is turned approximately 90 degrees by the sheet turning member, and is then subjected to image formation in an image forming means. The longitudinal direction of the recording sheet when stored in a sheet storage means forms an angle of approximately 90 degrees with respect to the longitudinal direction of the recording sheet when subjected to image formation in the image forming means.

In this case, the largest possible recording sheet on which image formation is possible is conveyed in the longitudinal direction thereof in the image forming means so that the direction of the short sides of the recording sheet coincides with the width direction of the feeding path. This minimizes the projection area of the printer, as viewed in the normal direction of the recording sheet in the sheet storage means.

The installation area of the printer of the present invention can be determined by the shorter dimension of the sheet storage means, which is the smallest among the longer dimension of the sheet storage means, the shorter dimension of the sheet storage means, and the longer dimension of the image forming means, and one of the other two dimensions. This considerably reduces the size of the printer, compared with the known printer whose installation area is determined by the dimensions other than the shorter dimension of the sheet storage means that is the smallest.

Further features and advantages of the present invention will become apparent from the following description of exemplary embodiments with reference to the attached drawings.

DESCRIPTION OF THE EMBODIMENTS

First Embodiment

Figure 1A:
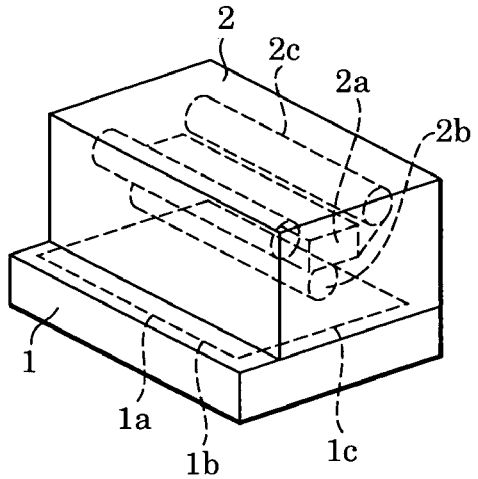
FIGS. 1A, 1B, and 1C are a perspective view, a plan view, and a side view, respectively, of a printer according to a first embodiment of the present invention.
Figure 1B:
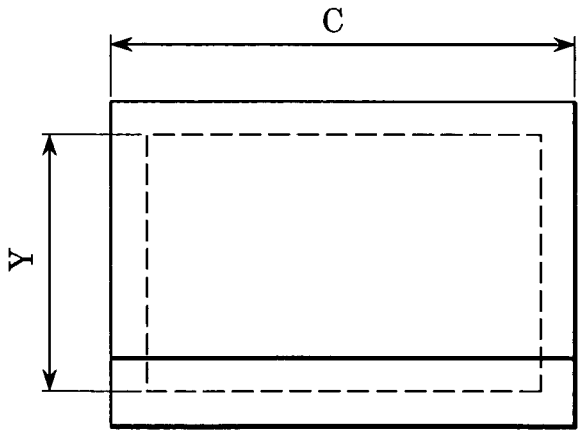
Figure 1C:
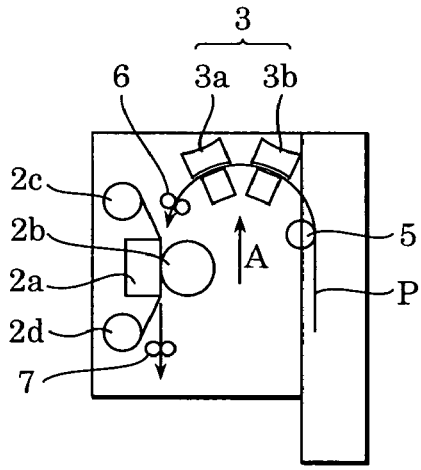
Figure 2:
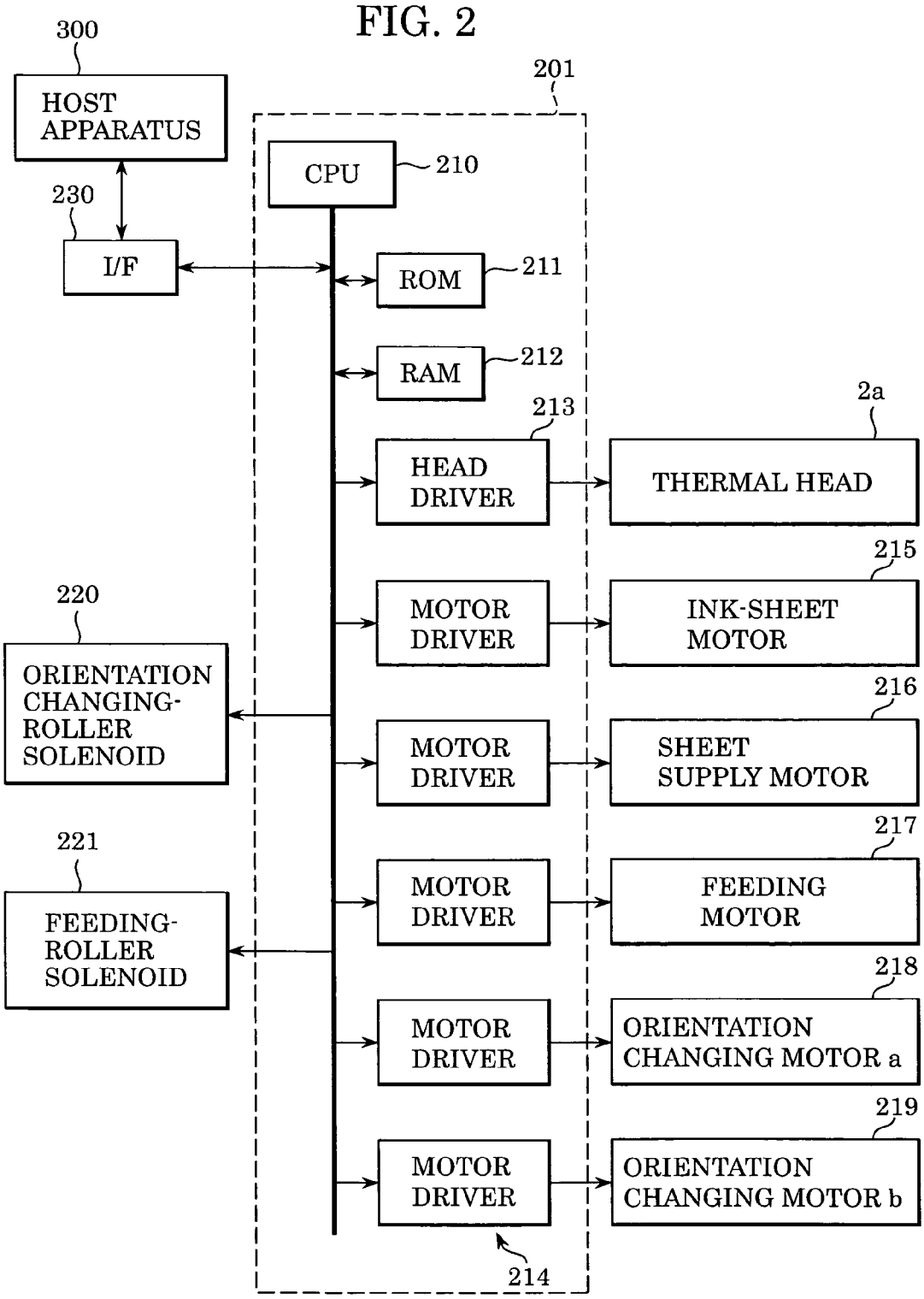
FIG. 2 is a control block diagram of the printer.

FIGS. 1A, 1B, and 1C show a printer according to a first embodiment of the present invention, and FIG. 2 is a control block diagram of the printer. As shown in FIGS. 1A to 1C, the printer of the first embodiment includes a sheet storage unit (a sheet storage means) 1 and an image forming unit (an image forming means) 2. A dotted area 1*a* shows the largest possible recording sheets on which image formation is possible. The sheet storage unit 1 is horizontally installed, and the image forming unit 2 is provided thereon. In this manner, the height and installation area of the printer are well balanced, as in the third example of the known printer shown in FIGS. 18A to 18C. The printer of the first embodiment is different from the third example in that the sheet storage unit 1 is placed so that the longitudinal direction of the largest possible recording sheets is parallel to the longitudinal direction of the image forming unit 2.

The image forming unit 2 includes a thermal head 2*a*, a platen roller 2*b*, and an ink sheet 2*c*. The image forming unit 2 performs printing by a thermal transfer method in which ink on the ink sheet 2*c* is transferred onto a recording sheet, which is pressed against the platen roller 2*b* by the thermal head 2*a*, by heat generated by the thermal head 2*a*.

The thermal head 2*a* includes a plurality of heating resistors arranged linearly. The heating resistors are selectively operated to generate heat according to image information, thereby transferring ink of the ink sheet 2*c*.

A pickup roller (supply member) 5 picks up a recording sheet P from the sheet storage unit 1, and two pairs of feeding rollers (feeding member) 6 and 7 feed the recording sheet P. The feeding rollers 6 and 7 feed the recording sheet P in a direction parallel to the planes of recording sheets stored in the sheet storage unit 1. A feeding path is curved between the pickup roller 5 and the feeding rollers 6.

Figure 3:
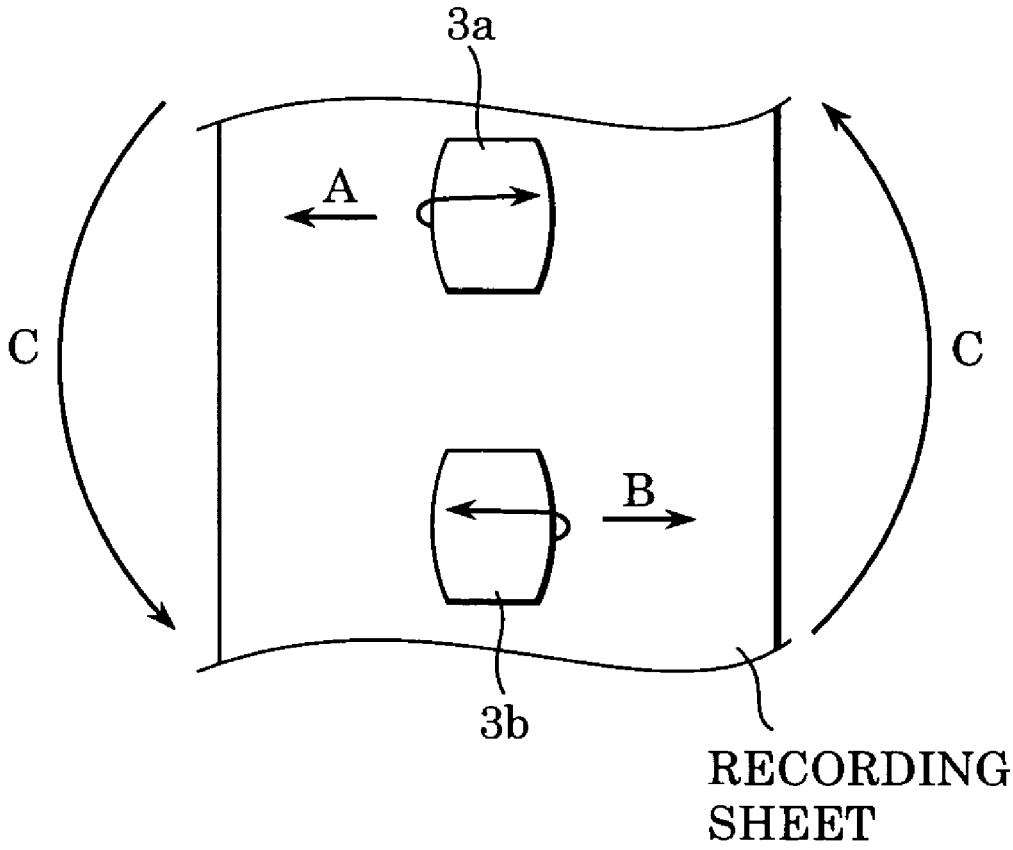
FIG. 3 is an operational diagram of the printer.

Two pairs of orientation-changing rollers 3*a* and 3*b* are provided. One of each pair of rollers is movable by an orientation-changing-roller solenoid 220 so that the rollers can nip a recording sheet from the front and rear sides. The orientation-changing rollers 3*a* and 3*b* correspond to the sheet turning member or the direction-changing mechanism (the direction-changing means) of the present invention. FIG. 3 is a view of the orientation-changing rollers 3*a* and 3*b*, as viewed in the direction of arrow A in FIG. 1C. The roller 3*a* (first orientation-changing roller) and the roller 3*b* (second orientation-changing roller) are independently driven by orientation-changing motors 218 and 219, respectively, and can be rotated in opposite directions. When the rollers 3*a* and 3*b* are rotated in such directions as to convey a recording sheet in opposite directions (directions of arrows A and B in FIG. 3), a couple of forces are produced in the recording sheet, and turn the recording sheet around an axis perpendicular to the plane of the recording sheet. In FIG. 3, the recording sheet is turned in the direction of arrows C.

In the first embodiment, the orientation-changing rollers 3*a* and 3*b* constitute the sheet turning member. Some specific mechanisms for turning the recording sheet have been proposed hitherto. For example, Japanese Patent Laid-Open No. 2002-234636 discloses that a recording sheet is turned with its center clamped from the front and rear sides, and Japanese Patent Laid-Open No. 9-40230 discloses that a couple of forces are produced by feeding rollers and a contact member that touches a recording sheet to prevent the recording sheet from traveling.

A control circuit of the printer will now be described in detail with reference to FIG. 2.

A control board 201 has control unit (control means) such as a CPU 210 that controls the printer and gives various control commands, a ROM 211 that stores control data and the like, and a RAM 212 serving as a region in which, for example, recording data is stored for conversion.

The control board 201 also includes a head driver 213 for driving the thermal head 2*a*, and a plurality of motor drivers 214. The motor drivers 214 respectively drive an ink-sheet motor 215 for driving a pulley 2*d* that takes up the ink sheet 2*c*, a sheet supply motor 216 for driving the pickup roller 5, a feeding motor 217 for driving the feeding rollers 6 and 7 and the platen roller 2*b*, and orientation-changing motors 218 and 219 for driving driving rollers of the orientation-changing rollers 3*a* and 3*b*.

The orientation-changing-roller solenoid 220 separates the driving rollers and driven rollers of the orientation-changing rollers 3*a* and 3*b*. A feeding-roller solenoid 221 separates a driving roller and a driven roller of the feeding rollers 6.

An interface 230 transmits and receives data to and from a host apparatus 300 such as a computer or a digital camera.

Figure 4:
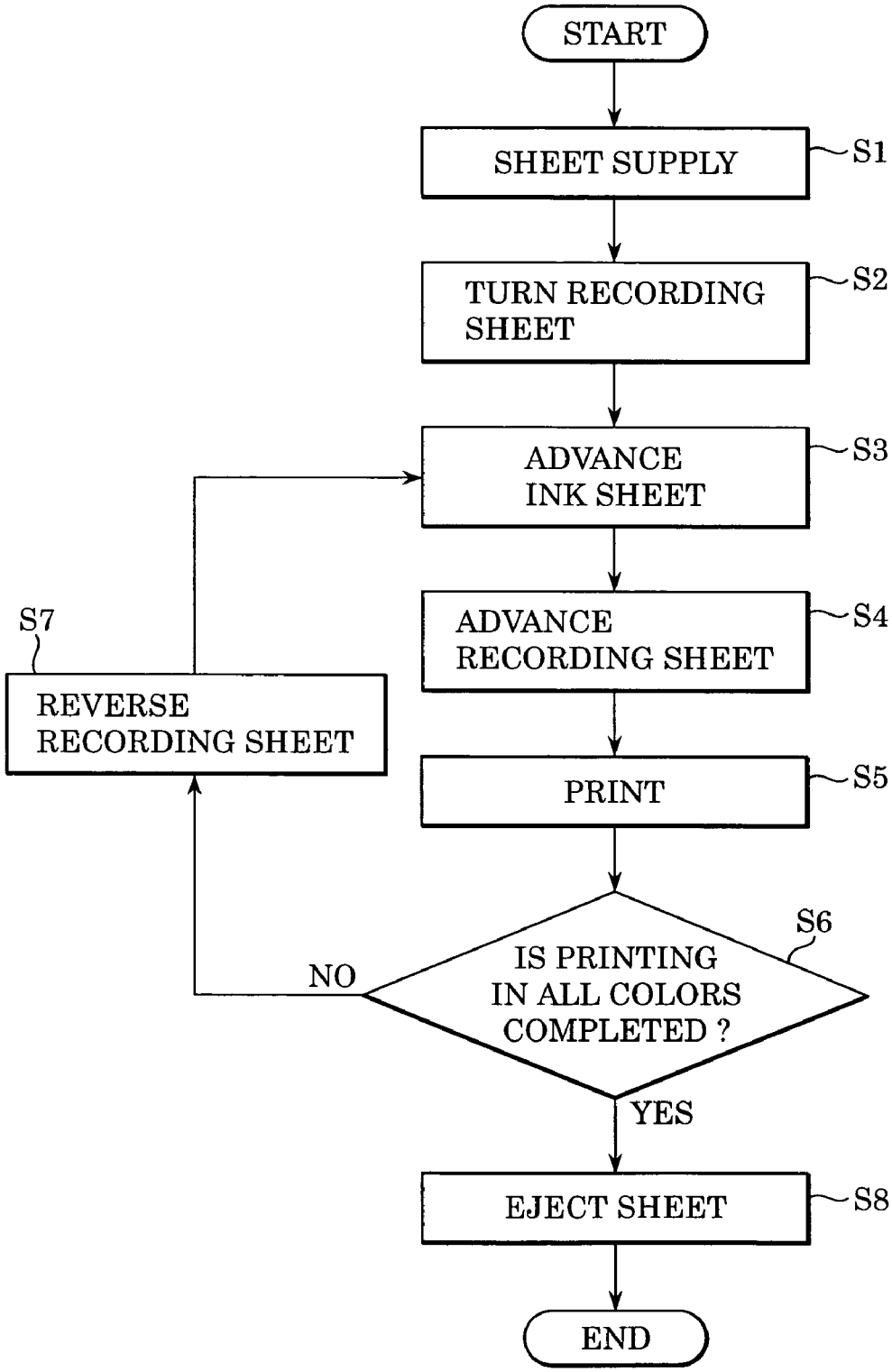
FIG. 4 is a flowchart showing the operation of the printer.
Figure 5A:
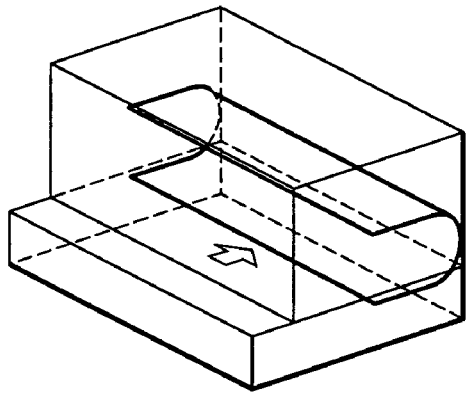
FIGS. 5A, 5B, and 5C are explanatory views showing a sheet supply operation of the printer.
Figure 5B:
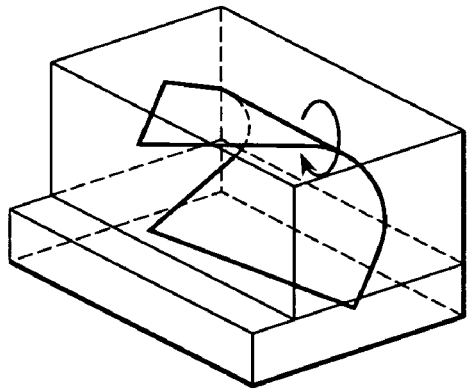
Figure 5C:
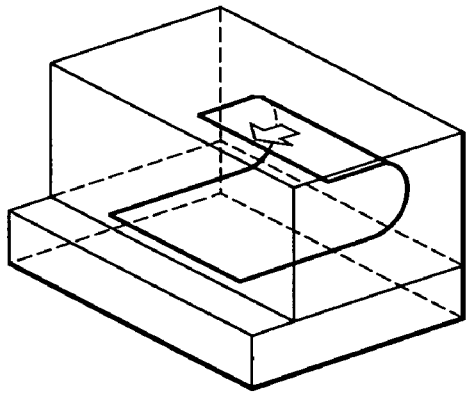

The operation of the printer will be described below with reference to FIG. 4 as a flowchart and FIGS. 5A to 5C. In Step S1 in FIG. 4, one recording sheet P is separated from recording sheets stacked in the sheet storage unit 1 by the pickup roller 5 and a separation and delivery member such as a friction member, as shown in FIG. 5A, and is conveyed to the image forming unit 2. The recording sheets are stacked in the sheet storage unit 1 so that their short sides 1*c* are parallel to the feeding direction. Long sides 1*b* of the recording sheet delivered by the pickup roller 5 remain parallel to the rotation axis of the platen roller 2*b* in the image forming unit 2.

When the recording sheet P enters between the orientation-changing rollers 3*a* and 3*b* in a separate state, in Step S2, the orientation-changing-roller solenoid 220 causes the orientation-changing rollers 3*a* and 3*b* to clamp the recording sheet P. The orientation-changing rollers 3*a* and 3*b* are driven by the orientation-changing motors 218 and 219 so as to feed the recording sheet P in opposite directions, thereby turning the recording sheet 90 degrees, as shown in FIG. 5B. Consequently, the short sides 1*c* of the recording sheet P are made parallel to the rotation axis of the platen roller 2*b* in the image forming unit 2. While the recording sheet P is being turned, one of the feeding rollers 6 in a separate position is moved by the feeding-roller solenoid 221 to clamp the recording sheet P. Then, the recording sheet P is conveyed in the longitudinal direction for image formation, as shown in FIG. 5C.

In Steps S3 and S4, a transfer start portion of the ink sheet 2*c* and a leading edge of the recording sheet P are conveyed to the thermal head 2*a* by controlling the ink-sheet motor 215 and the feeding motor 217. The recording sheet P conveyed between the feeding rollers 6 is clamped together with the ink sheet 2*c* by the thermal head 2*a* and the platen roller 2*b*. In this state, ink on the ink sheet 2*c* is thermally transferred onto the recording sheet P by heat generated by the thermal head 2*a* to perform image formation (Step S5).

When printing in one color is completed, the thermal head 2*a* is separated from the platen roller 2*b*, and the recording sheet P is conveyed by the feeding rollers 6 and 7 in a direction reverse to the direction in the previous printing operation (Step S7), and is returned to the print start position for the next printing operation in the second color. Simultaneously, a second-color transfer position of the ink sheet 2*a* is shifted to the thermal head 2*a*. Then, printing in the second color is performed in a manner similar to that in the first color. These operations are repeated for printing in the third and subsequent colors. When printing in all the colors is completed (Step S6), the recording sheet P is ejected (Step S8).

In the printer of the first embodiment, the longitudinal direction of recording sheets (direction of the long sides) stored in the sheet storage unit 1 is parallel to the longitudinal direction of the image forming unit 2 (direction of the thermal head 2*a* and the platen roller 2*b*) in this way. A separated and delivered recording sheet is turned 90 degrees so that the short sides thereof is parallel to the longitudinal direction of the image forming unit 2, and is then fed for image formation with its long sides oriented in the feeding direction, as in the related arts. Since the longer dimension of the image forming unit 2 is determined with reference to the shorter dimension of the recording sheet, image formation cannot be performed without turning the recording sheet 90 degrees in a state in which the long sides of the recording sheet are parallel to the long sides of the image forming unit 2. Even if an attempt is made to perform image formation on the recording sheet in such a state, the longer dimension of the image forming unit 2 is further increased.

Figure 6A:
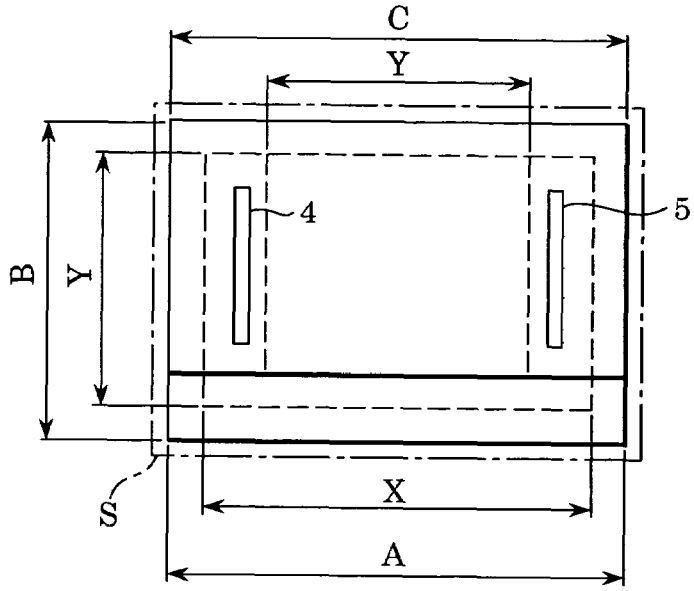
FIGS. 6A and 6B are explanatory views of the printer, ad
Figure 6B:
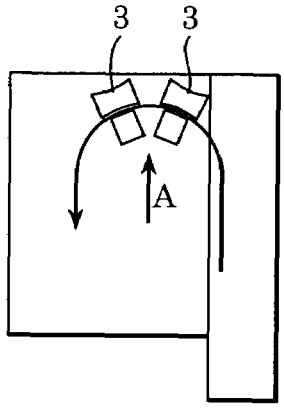
Figure 6C:
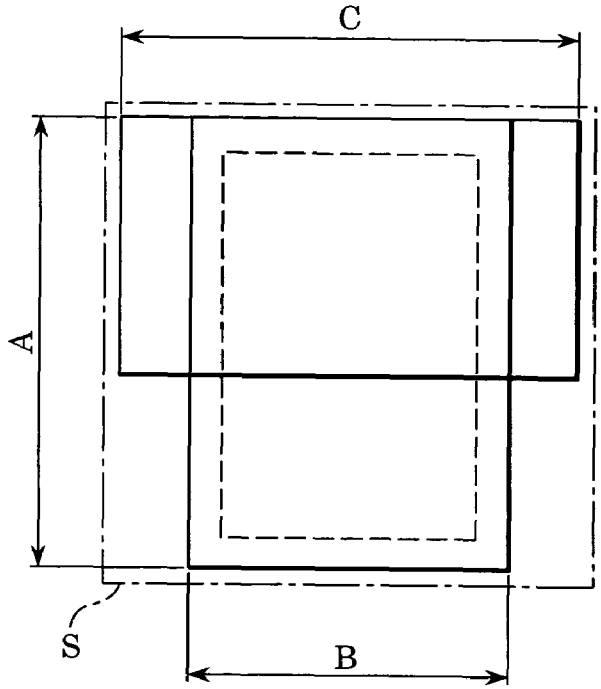
FIGS. 6C and 6D are explanatory views of a printer as a comparative example.
Figure 6D:
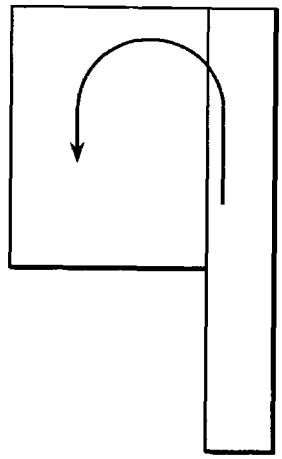

FIGS. 6A and 6B are a plan view and a side view, respectively, of the printer of the first embodiment. In FIG. 6A, A and B indicate the longer dimension and the shorter dimension of the sheet storage unit 1 that are slightly larger than the longer dimension X and the shorter dimension Y of the recording sheet by lengths corresponding to a standing wall and a frame that regulate the recording sheet. The longer dimension C of the image forming unit 2 is larger than the shorter dimension Y of the recording sheet because side plates 4 and 5 and mechanical components, such as motors and gears, are provided outside the shorter dimension Y, as described above. In the first embodiment, the longer dimension C of the image forming unit 2 is equal to the longer dimension A of the sheet storage unit 1. FIGS. 6C and 6D are a plan view and a side view, respectively, showing the related art shown in FIGS. 18A to 18C for comparison.

As described above, the longer dimension A and the shorter dimension B of the sheet storage unit 1 are larger than the longer dimension X and the shorter dimension Y of the recording sheet because of the existence of the frame and the like, and the longer dimension C of the image forming unit 2 is larger than the shorter dimension Y of the recording sheet because of the existence of the side plates and the mechanical components. In the related art shown in FIGS. 6C and 6D, the projection area of the printer is determined by the product of the dimensions A and C other than the smallest dimension B. This is because the sheet storage unit extends in the same direction as the feeding direction during image formation so that the short sides of the recording sheet conveyed to the image forming unit are parallel to the long sides of the image forming unit.

In contrast, the projection area of the printer of the first embodiment shown in FIGS. 6A and 6B is determined by the product of the dimensions B and A (or B and C) including the smallest dimension B. While the long sides of the sheet storage unit 1 are made parallel to the long sides of the image forming unit 2 in order to reduce the installation area, the delivered recording sheet can be conveyed during image formation with its short sides parallel to the long sides of the image forming unit because it is turned 90 degrees.

In addition, the recording sheet is turned around a curved portion. When the recording sheet is turned in a planar state, a diagonal dimension that is larger than the longer dimension is required at the long and short sides of the image forming unit 2. In contrast, when the recording sheet is turned in a curved state, the diagonal dimension is required only at the long sides. Since the turning recording sheet temporarily protrudes in both cases, it is only necessary to provide an opening, from which the corners of the recording sheet stick out, in the frame of the printer. There is no need to increase the size of the printer.

As described above, the printer of the first embodiment includes the sheet turning member that can turn a recording sheet around a straight line parallel to the normal direction. A recording sheet separated and delivered by the supply member is turned approximately 90 degrees by the sheet turning member, and is then subjected to image formation in the image forming unit.

Accordingly, the installation area of the printer can be determined by the shorter dimension of the sheet storage unit, which is the smallest among the longer dimension of the sheet storage unit, the shorter dimension of the sheet storage unit, and the longer dimension of the image forming unit, and one of the other dimensions. This considerably reduces the projection area of the printer, compared with the related arts.

Figure 16A:
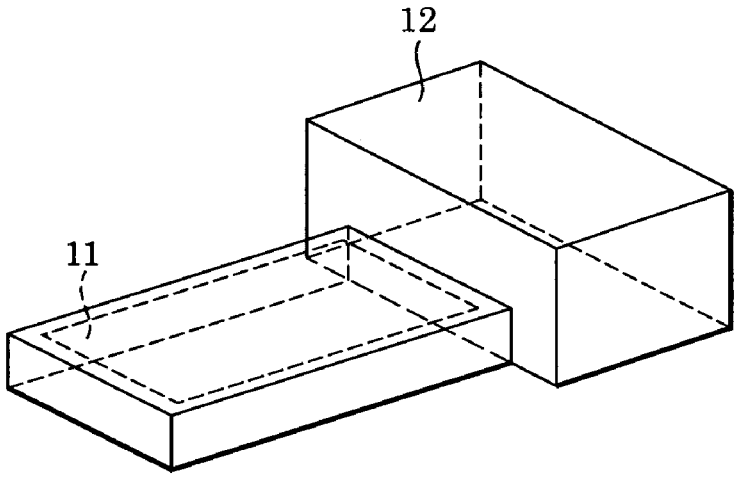
FIGS. 16A, 16B, and 16C are a perspective view, a plan view, and a side view, respectively, of a first example of a known printer.
Figure 16B:
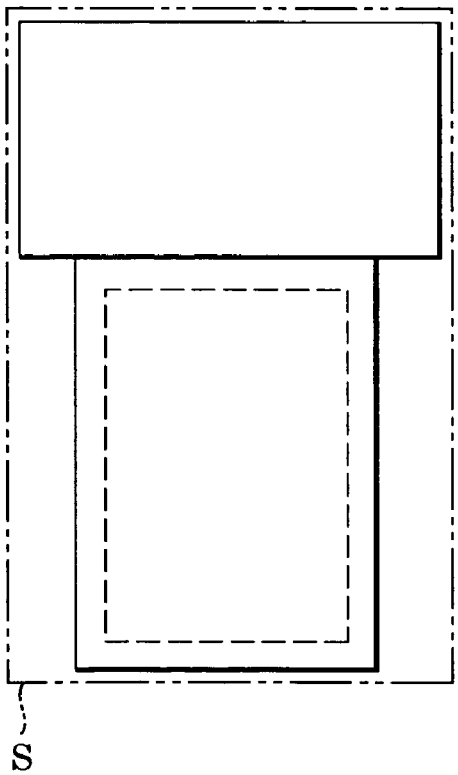
Figure 16C:
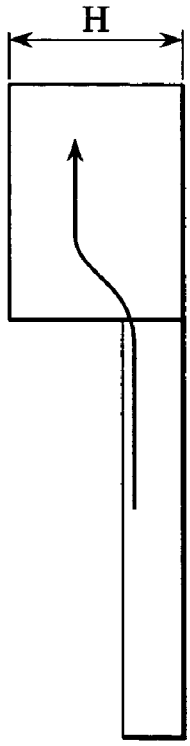
Figure 17A:
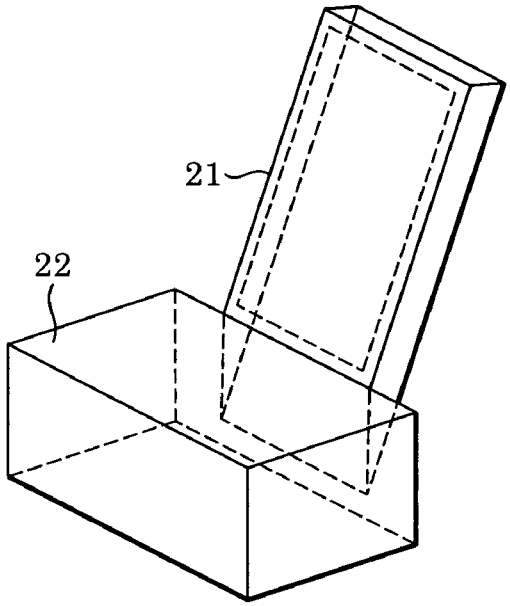
FIGS. 17A, 17B, and 17C are a perspective view, a plan view, and a side view, respectively, of a second example of a known printer.
Figure 17B:
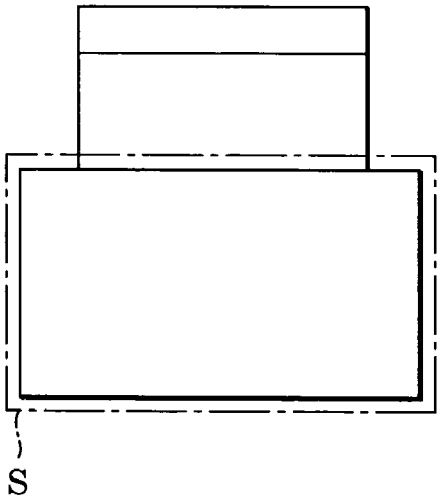
Figure 17C:
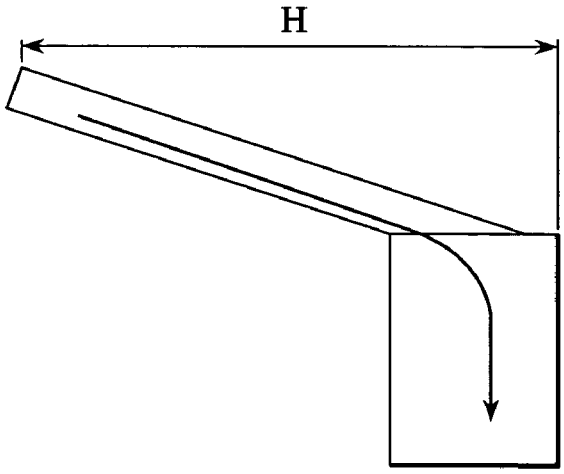
Figure 18A:
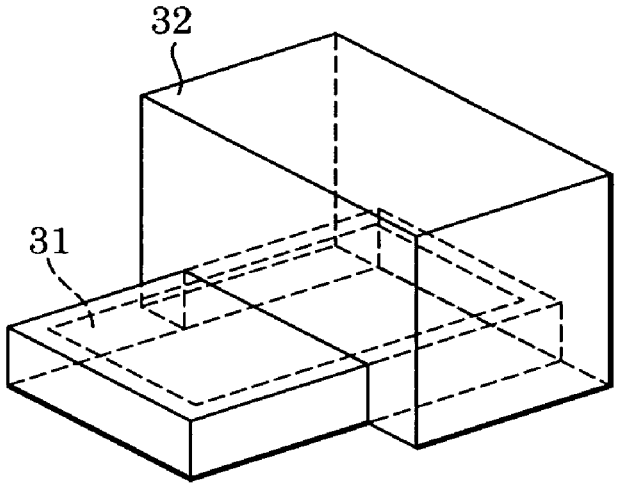
FIGS. 18A, 18B, and 18C are a perspective view, a plan view, and a side view, respectively, of a third example of a known printer.
Figure 18B:
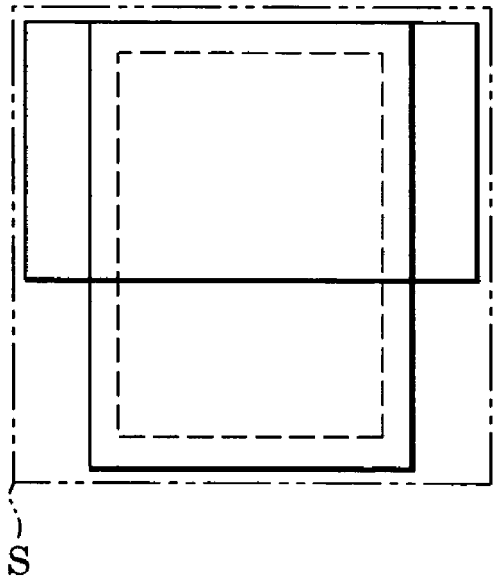
Figure 18C:
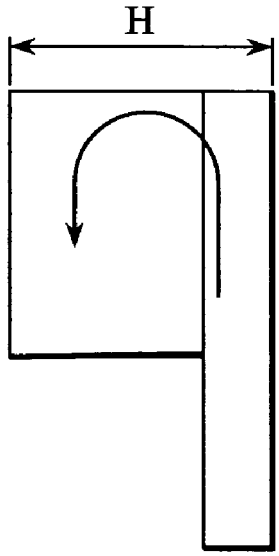

While the present invention is applied to the related art shown in FIGS. 18A to 18C in the first embodiment, similar advantages can be provided by applying the present invention to the related arts shown in FIGS. 16 and 17.

While the image forming unit adopts thermal transfer printing in the first embodiment, the advantages of the present invention can be provided, regardless of the recording method. Therefore, the present invention can be widely applied to various recording methods such as electrophotography, ink-jet printing, and thermal printing.

While the recording sheet is turned 90 degrees after separation and delivery in the first embodiment, the time for turning and the time for separation and delivery may overlap with each other, that is, the recording sheet may be turned while being separated and delivered. Similar advantages can be provided as long as the recording sheet can be conveyed during image formation at an angle of approximately 90 degrees to the direction in which the recording sheet is oriented in the sheet storage unit immediately before delivery.

Second Embodiment

Figure 7A:
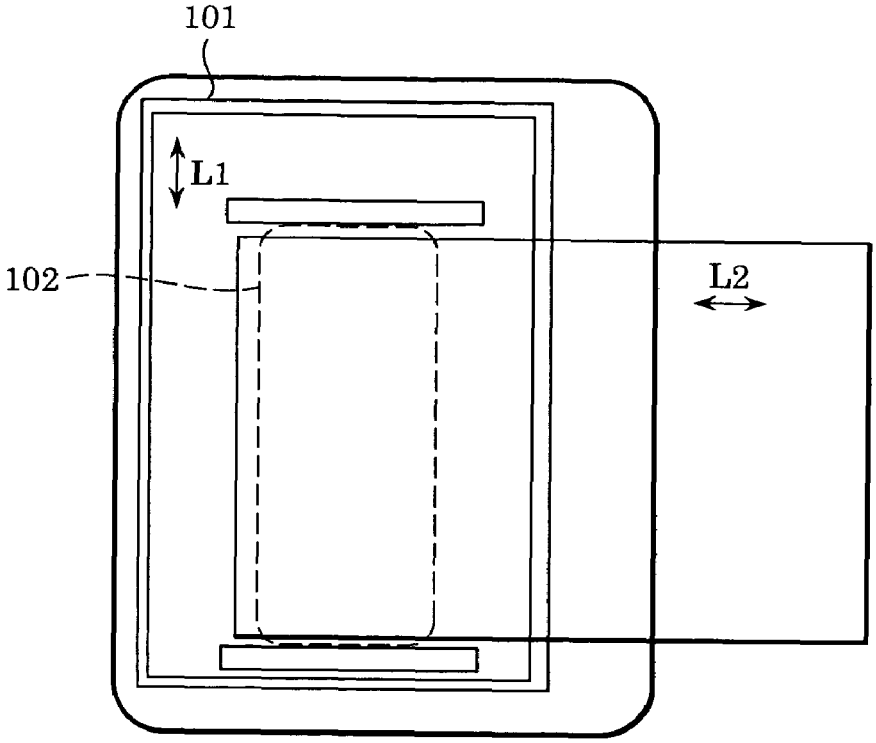
FIGS. 7A and 7B are a plan view and a cross-sectional view, respectively, of an image forming apparatus according to a second embodiment of the present invention.
Figure 7B:
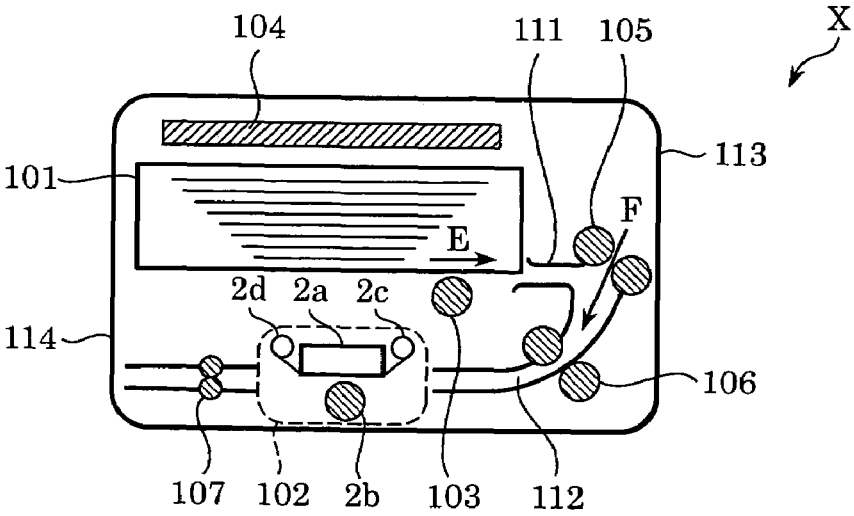

FIGS. 7A and 7B are a plan view and a cross-sectional view, respectively, of an image forming apparatus according to a second embodiment of the present invention. As shown in FIGS. 7A and 7B, the image forming apparatus includes a sheet storage unit 101 and an image forming unit 102. One of recording sheets stored in the sheet storage unit 101 is supplied in the direction of arrow E in FIG. 7B, is turned 90 degrees by a feeding method described below, and is then conveyed to the image forming unit 102 for image formation (hereinafter, the direction E will be referred to as the "supply direction"). The image forming apparatus is characterized in that the direction L1 of the long sides of the recording sheet in the sheet storage unit 101 is orthogonal to the direction L2 of the long sides of the recording sheet conveyed through the image forming unit 102, as shown in FIG. 7A.

Feeding members in the image forming apparatus will be described below. The feeding members include a sheet supply roller 103 serving as a first feeding means and provided adjacent to the sheet storage unit 101, a sheet support plate 104 provided on a side of the recording sheets in the sheet storage unit 101 remote from the sheet supply roller 103, a pair of orientation-changing rollers 105 serving as a second feeding means and provided on the downstream side of the sheet storage unit 101 in the feeding direction, a pair of feeding rollers 106 serving as a third feeding means provided in the image forming unit 102 remote from the sheet storage unit 101, and a pair of feeding rollers 107 provided on the downstream side of the image forming unit 102.

A first sheet feeding path 111 is provided between the sheet supply roller 103 and the orientation-changing rollers 105, and a second sheet feeding path 112 is provided from the orientation-changing rollers 105 to the image forming unit 102 via the feeding rollers 106. The image forming apparatus has an opening 113 provided on the supply side of the orientation-changing rollers 105, and a sheet-ejection opening 114 provided on the downstream side of the image forming unit 102.

Figure 8:
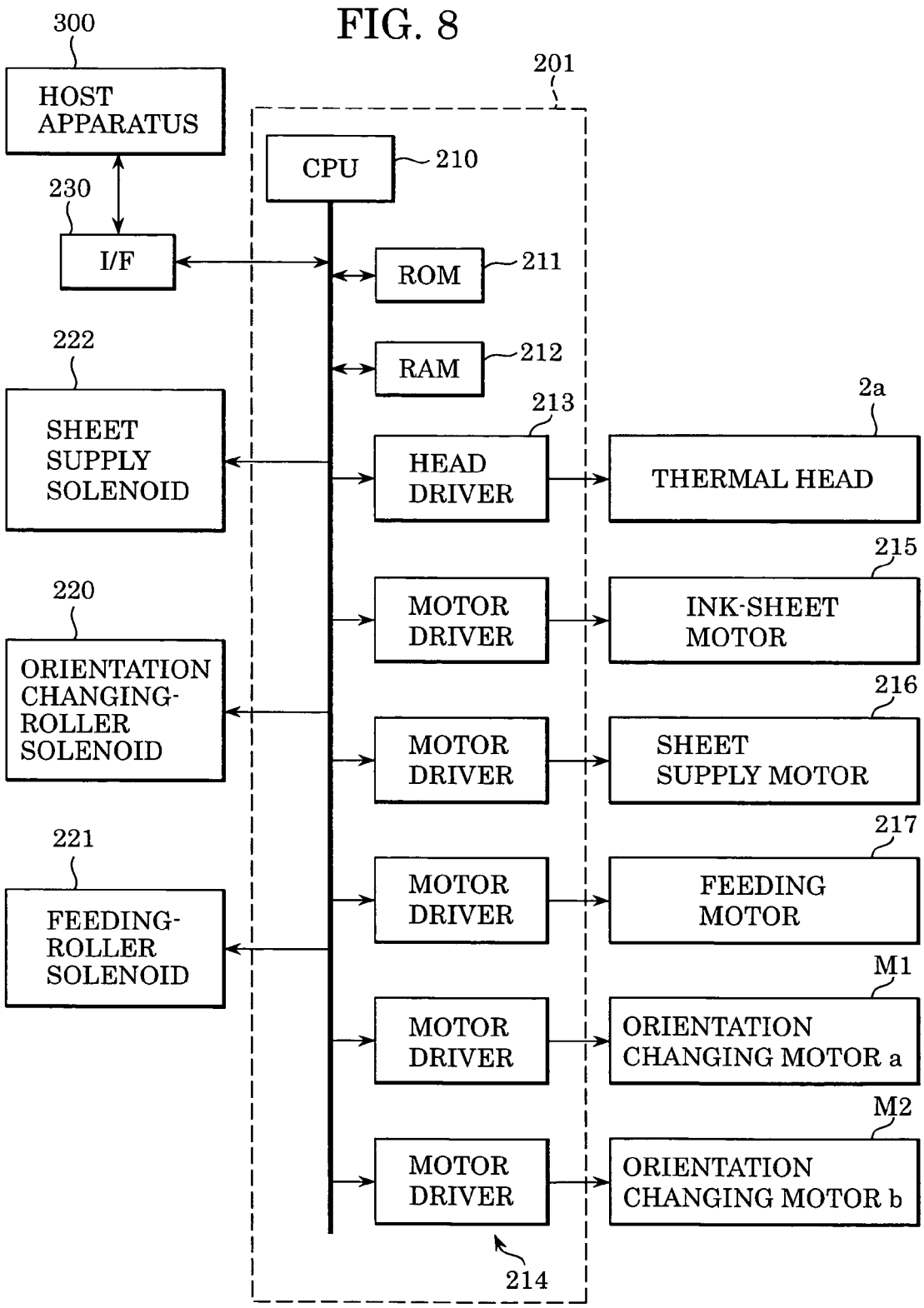
FIG. 8 is a control block diagram of the image forming apparatus.

FIG. 8 is a control block diagram of the image forming apparatus of the second embodiment. Components similar to those in the first embodiment are denoted by the same reference numerals, and descriptions thereof are omitted. A sheet supply solenoid 222 moves at least one of the sheet supply roller 3 and the sheet support plate 4 to press or separate the sheet supply roller 3 against or from the recording sheet.

Figure 9A:
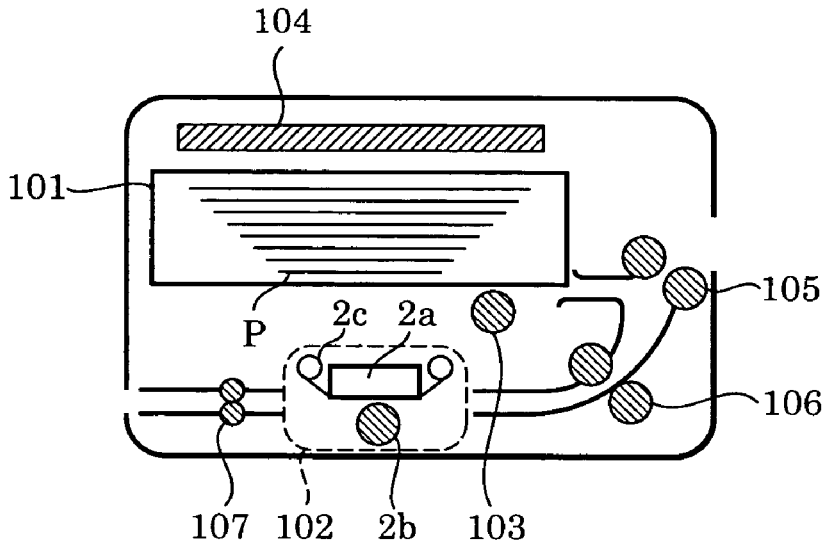
FIGS. 9A and 9B are explanatory views showing the operation of the image forming apparatus.
Figure 9B:
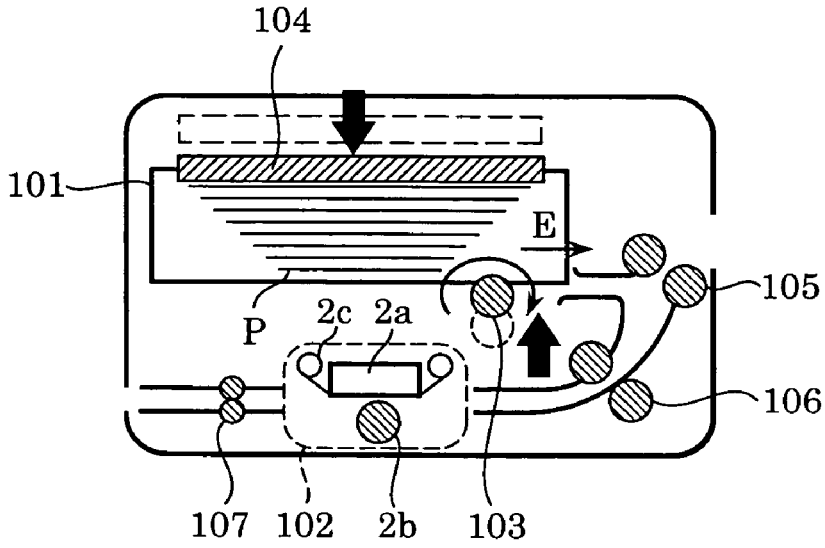

FIGS. 9A and 9B show the operation of the sheet supply roller 103 and the sheet support plate 4. The sheet supply roller 103 is rotatably supported by a sheet supply motor 216 serving as a rotating mechanism. The sheet supply solenoid 222 switches between a separate state in which at least one of the sheet supply roller 103 and the sheet support plate 104 is moved away from the other, as shown in FIG. 9A, and a pressed state in which at least one of the sheet supply roller 103 and the sheet support plate 104 is moved closer to the other so that the sheet supply roller 103 is pressed against the recording sheet, as shown in FIG. 9B. In the pressed state shown in FIG. 9B, when the supply motor 103 is rotated by the supply motor 216 in the direction of the arrow, one of the recording sheets in the sheet storage unit 101 is delivered in the supply direction.

FIGS. 10A to 10D are explanatory views of the orientation-changing rollers 105, as viewed in the direction of arrow X in FIG. 7B. One of the orientation-changing rollers 105 includes a driving roller 105*a* rotatably supported by a orientation-changing motor M1 serving as a rotating mechanism, and a driven roller 105*c* opposing the driving roller 105*a*, and the other includes a driving roller 105*b* rotatably supported by a orientation-changing motor M2 serving as a rotating mechanism, and a driven roller 105*d* opposing the driving roller 105*b*.

Figure 10A:
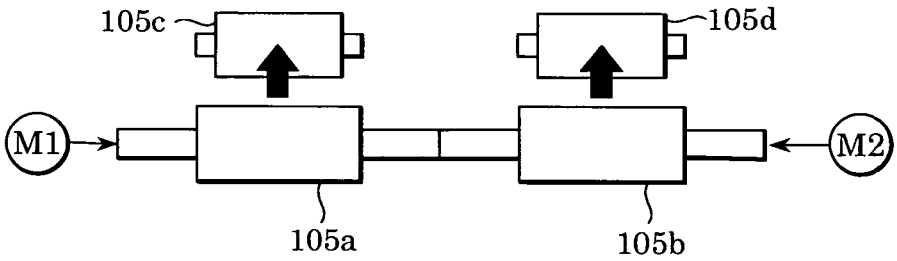
FIGS. 10A, 10B, 10C, and 10D are operational diagrams of the image forming apparatus.
Figure 10B:
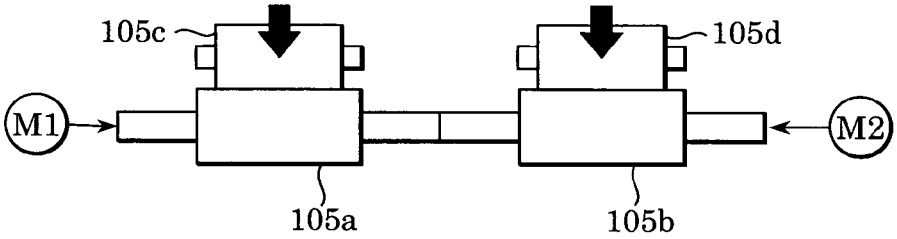
Figure 10C:
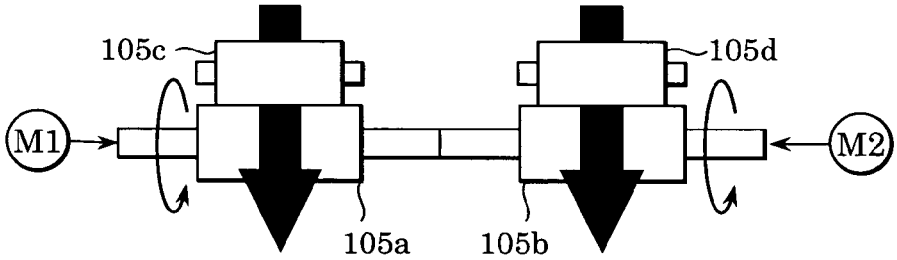
Figure 10D:
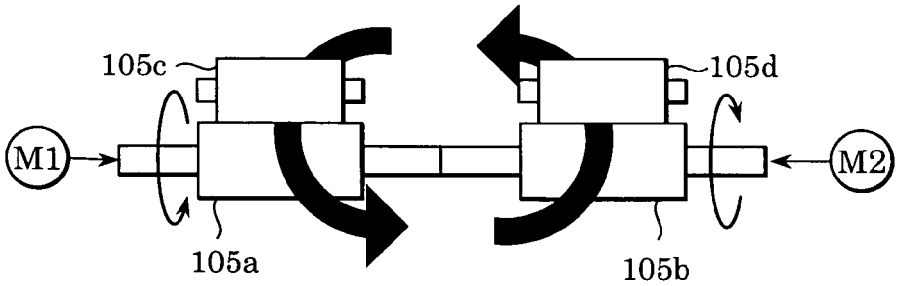

For each of the orientation-changing rollers 105, a orientation-changing-roller solenoid 220 serving as a driving mechanism switches between a separate state (FIG. 10A) in which at least one of the driving roller 105*a* or 105*b* and the driven roller 105*c* or 105*d* is moved away from the other, and a pressed state (FIG. 10B) in which at least one of the rollers is moved into pressing contact with the other. The driving rollers 105*a* and 105*b* are coaxially supported, but are connected to the different orientation-changing motors M1 and M2. The driving rollers 105*a* and 105*b* can rotate in the same direction, as shown in FIG. 10C, and can also rotate in opposite directions, as shown in FIG. 10D.

Therefore, when the driving rollers 105*a* and 105*b* are rotated in the same direction while being in pressing contact with the driven rollers 105*c* and 105*d*, a recording sheet is conveyed in the supply direction or in the direction opposite thereto. When the driving rollers 105*a* and 105*b* are rotated in opposite directions, the orientation of the recording sheet is changed.

While the driving rollers 105*a* and 105*b* are in pressing contact with the driven rollers 105*c* and 105*d*, a common tangent (arrow F in FIG. 7B) at the nips therebetween does not extend in the first feeding path 111, but extends in the second feeding path 112.

Figure 11A:
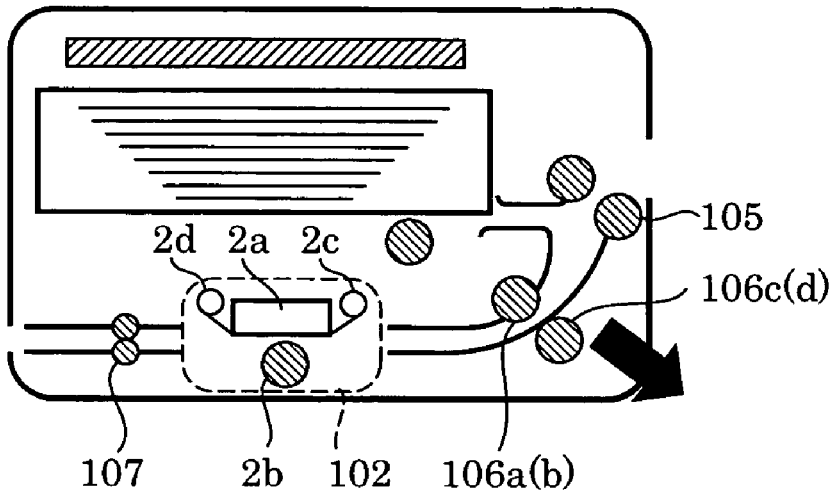
FIGS. 11A and 11B are explanatory views showing the operation of the image forming apparatus.
Figure 11B:
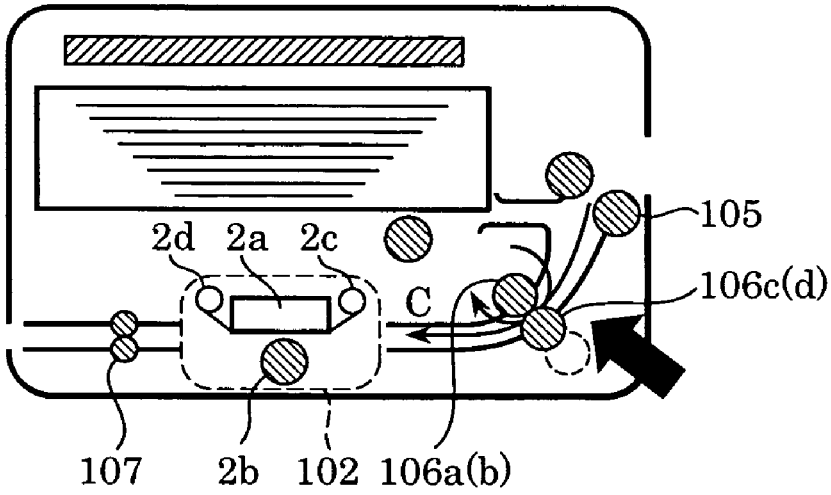

FIGS. 11A and 11B show the operation of the feeding rollers 106. The feeding rollers 106 include a driving roller 106*a* and a driven roller 106*b* opposing each other. The driving roller 106*a* can be driven by a feeding motor 217 serving as a rotating mechanism.

By moving at least one of the driving roller 106*a* and the driven roller 106*b* by a feeding-roller solenoid 221 serving as a driving mechanism, switching is made between a separate state (FIG. 11A) in which the rollers 106*a* and 106*b* are separate from each other, and a pressed state (FIG. 11B) in which the rollers 106*a* and 106*b* are in pressing contact with each other. When the driving roller 106*a* is rotated in the direction of the arrow in the pressed state shown in FIG. 11B, the recording sheet is conveyed in the direction (direction of arrow C) opposite the supply direction.

The operation of the image forming apparatus will be described below with reference to FIGS. 12A to 12F as operational diagrams and FIG. 13 as a flowchart.

Figure 12A:
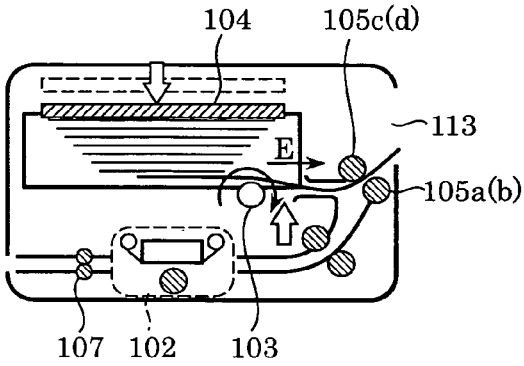
FIGS. 12A to 12F are operational diagrams of the image forming apparatus.
Figure 13:
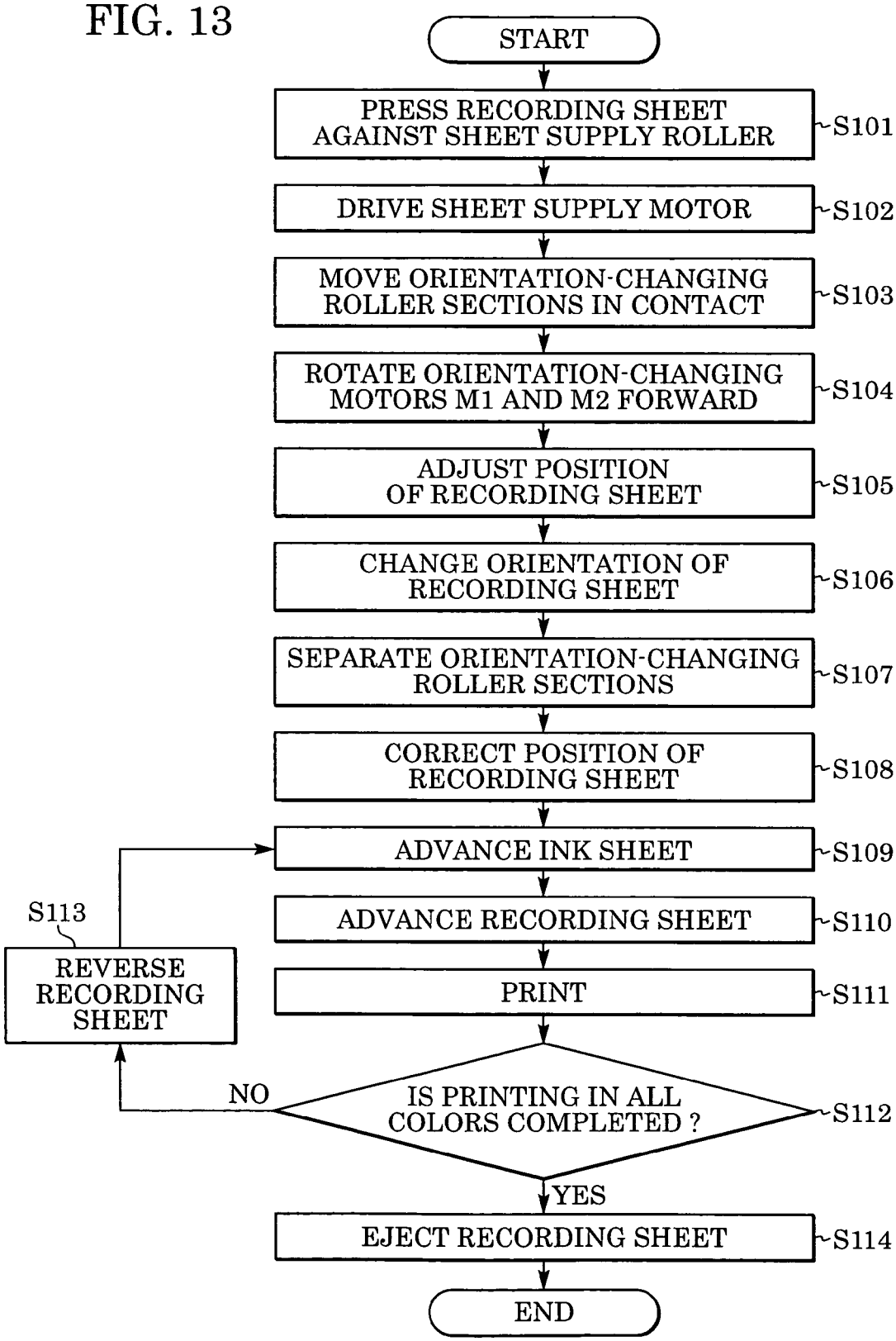
FIG. 13 is a flowchart showing the operation of the image forming apparatus.

In Step S101 in FIG. 13, a controller 201 activates the sheet-supply solenoid 222 to move the sheet supply plate 104 downward so that recording sheets and the sheet supply roller 103 are brought into pressing contact with each other. In Step S102, the sheet supply roller 103 is rotated clockwise by the sheet-supply motor 216 to deliver the lowermost one P of the recording sheets, as shown in FIG. 12A (first operation). The second lowermost recording sheet that does not directly receive a delivery force from the sheet supply roller 103 is prevented by a separation frictional member from being delivered.

The delivered recording sheet P is stopped after its leading end reaches between the orientation-changing rollers 105 that are in a separate state. In this case, preferably, the orientation-changing rollers 105 are made separate in order to reduce the feeding resistance when the leading end enters therebetween. If the orientation-changing rollers 105 are in a pressed state, for example, they should be rotated to reduce the feeding resistance.

In Step S103, the orientation-changing-roller solenoid 220 is operated so that the recording sheet is nipped between the driving rollers 105*a* and 105*b* and the driven rollers 105*c* and 105*d*. In Step S104, the orientation-changing motors M1 and M2 are rotated forward to rotate the driving rollers 105*a* and 105*b*, thereby conveying the delivered recording sheet P in the supply direction.

In this case, the sheet supply roller 103 and the sheet support plate 104 may be placed in an arbitrary state. The feeding rollers 106 may also be placed in an arbitrary state. When the orientation-changing rollers 105 rotate in this state, the lowermost recording sheet P is delivered and completely drawn out from the sheet storage unit 101 (second operation). Since the orientation-changing rollers 105 are arranged so that the common tangent at the nips between the driving rollers 105*a* and 105*b* and the driven rollers 105*c* and 105*d* is placed in the second feeding path 112, the recording sheet P is conveyed in a curved manner between the first feeding path 111 and the orientation-changing rollers 105.

Figure 12B:
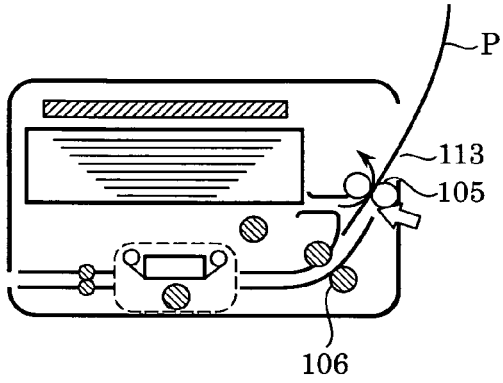

The drawing operation is stopped after the trailing end of the delivered recording sheet P comes out of the sheet storage unit 101 and the first feeding path 111. When the trailing end of the recording sheet P passes through the first feeding path 111, the recording sheet P returns from the curved state to a flat state because of its own elasticity, and the trailing end is pointed toward the second feeding path 112, as shown in FIG. 12B. The front half of the recording sheet protrudes from the apparatus through the opening 113.

In order to reduce a resistance given when the recording sheet P is drawn out, the sheet-supply solenoid 222 is preferably placed in an OFF state so that the sheet supply roller 103 and the stacked recording sheets are out of pressing contact. When the sheet supply roller 103 and the recording sheets are in pressing contact, the orientation-changing rollers 105 need to produce a feeding force stronger than the resistance.

Figure 12C:
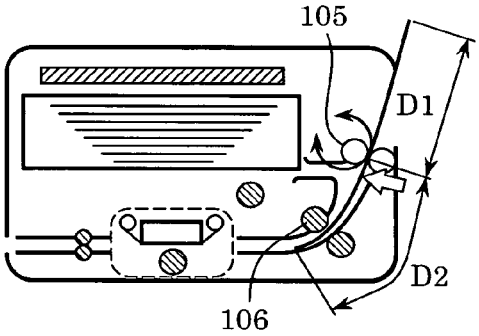

FIG. 12C shows a positioning operation serving as a third operation of the image forming apparatus (Step S105). The position of the recording sheet P is adjusted by rotating the orientation-changing motors M1 and M2 forward or in reverse so that the orientation-changing rollers 105 nip almost the center of the recording sheet in the feeding direction, that is, so that the distance D1 from the leading end of the recording sheet P and the nips between the orientation-changing rollers 105 is equal to the distance D2 between the trailing end of the recording sheet P and the nips. In FIG. 12C, the orientation-changing motors M1 and M2 rotate in reverse to convey the recording sheet P in the direction reverse to the supply direction until the orientation-changing rollers 105 nip almost the center of the recording sheet P in the feeding direction.

In this case, the feeding rollers 106 may be separate so as to freely pass the recording sheet P therebetween, or may be rotated in the same direction as that of the orientation-changing rollers 105 to convey the recording sheet P.

When the center of the recording sheet P in the feeding direction is nearly placed at the orientation-changing rollers 105 at the completion of the drawing operation as the second operation, the positioning operation is not performed. When the center is placed on the downstream side of the orientation-changing rollers 105, the recording sheet P is conveyed in the direction reverse to the supply direction. Conversely, when the center is placed on the upstream side, the recording sheet P is conveyed in the supply direction. In order to reduce the feeding resistance given when the recording sheet P is conveyed, the feeding rollers 106 are preferably separate. If the feeding rollers 106 are in pressing contact, the feeding resistance must be reduced, for example, by rotating the orientation-changing rollers 105. The feeding rollers 106 may be placed in an arbitrary state in a case in which the recording sheet is too small to reach the feeding rollers 106 during the positioning operation.

Figure 12D:
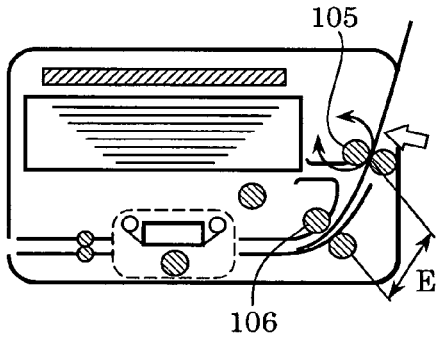

In Step S105, an operation for changing the orientation of the recording sheet P is performed as a fourth operation of the image forming apparatus. FIG. 12D illustrates the orientation-changing operation. The sheet supply roller 103 and the sheet support plate 104 are in an arbitrary state, the orientation-changing rollers 105 are in a pressed state, and the feeding rollers 106 are in a separate state. In this state, the driving rollers 105*a* and 105*b* of the orientation-changing rollers 105 are rotated in opposite directions by rotating the orientation-changing motors M1 and M2 in opposite directions, as shown in FIG. 10D. Consequently, the delivered recording sheet P is turned approximately 90 degrees in the image forming unit 102, and the long sides of the recording sheet P perpendicular to the feeding direction are placed parallel to the feeding direction. The orientation-changing operation is stopped after the recording sheet P is turned approximately 90 degrees.

When the recording sheet P reaches the feeding rollers 106 while being turned, the feeding rollers 106 are in a separate state. If the recording sheet P is too small to reach the feeding rollers 106 (the dimension E in FIG. 12D is sufficiently large), the feeding rollers 106 may be in pressed contact with each other. The recording sheet P is turned during the orientation-changing operation while being partly exposed outside from the opening 113 of the apparatus.

Figure 12E:
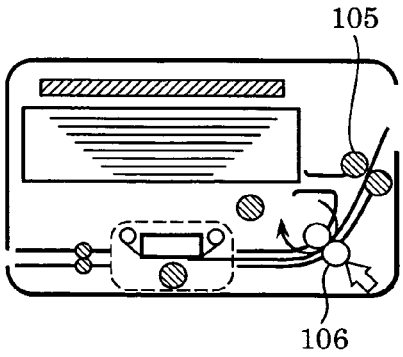
Figure 12F:
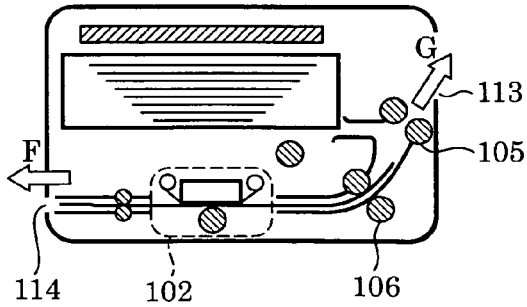

FIG. 12E illustrates a feeding operation before image formation as a fifth operation of the image forming apparatus. The sheet supply roller 103 and the sheet support plate 104 are in an arbitrary state, and at least one of the orientation-changing rollers 105 and the feeding rollers 106 are in a pressed state. In this state, the recording sheet P is conveyed to the image forming unit 102 by rotating the orientation-changing rollers 105 and/or the feeding rollers 106 that are in a pressed state (Step S107). The feeding operation is stopped after the leading end of the recording sheet P reaches the image forming unit 102 (Step S109). The recording sheet may be conveyed by the orientation-changing rollers 105 or the feeding rollers 106, or by both rollers that are in a pressed state.

Figure 14A:
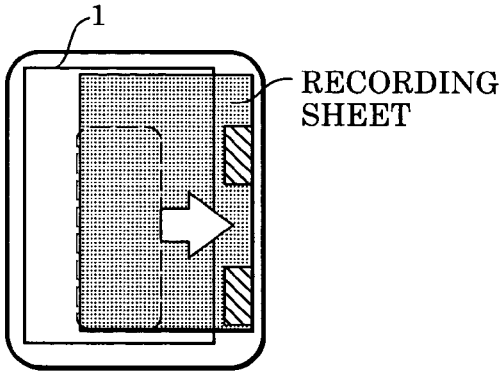
FIGS. 14A to 14F are operational diagrams of the image forming apparatus.
Figure 14B:
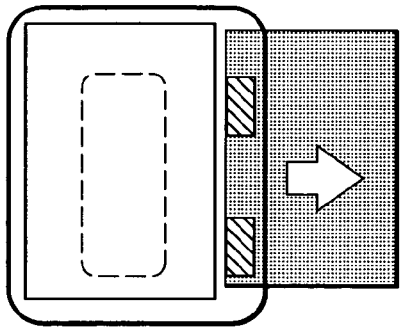
Figure 14C:
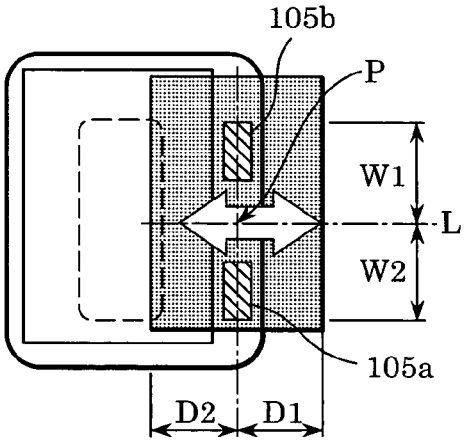
Figure 14D:
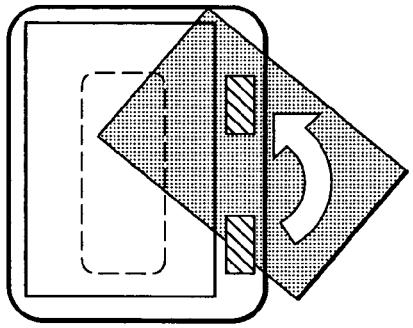
Figure 14E:
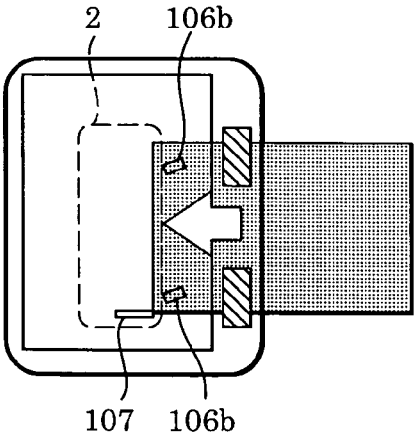

During the fifth operation, a position adjusting operation for the recording sheet may be performed, that is, the side edges of the recording sheet can be adjusted to be parallel to the feeding direction. In this case, as shown in FIG. 14E, one of the feeding rollers 106, for example, the driven rollers 106*b* are placed at an angle to the feeding direction. When the recording sheet is conveyed by the feeding rollers 106, it travels with its side edge in contact with a reference wall 107 formed of a projection provided in the feeding path. Consequently, the side edge is made parallel to the feeding direction. The rollers that are obliquely placed in this way are generally called "oblique feeding rollers".

When the driven rollers 106*b* of the feeding rollers 106 serve as the oblique feeding rollers so as to regulate the position of the recording sheet to be parallel to the feeding direction during the fifth operation, the orientation-changing rollers 105 are separated in Step S107 so as not to give a resistance to the oblique feeding rollers.

Figure 14F:
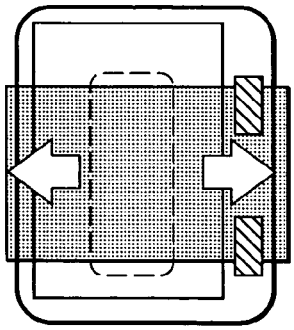

After the fifth operation, image formation is performed in the image forming unit 102, as shown in FIG. 14F.

First, a transfer start position of an ink sheet 2*c* and the leading end of the recording sheet P are conveyed to a thermal head 2*a* (Steps S109 and S110). The recording sheet P conveyed between the feeding rollers 106 and 107 is clamped together with the ink sheet 2*c* by a thermal head 2*a* and a platen roller 2*b*, and ink on the ink sheet 2*c* is thermally transferred onto the recording sheet P by heat generated by the thermal head 2*a* (Step S111).

After printing in the first color is completed, the recording sheet P is released by separating the thermal head 2*a* from the platen 2*b*, is conveyed by the feeding rollers 106 and 107 in the direction reverse to the direction during printing (Step S113), and is returned to the print start position for printing in the second color. Simultaneously, a transfer start portion of the ink sheet 2*c* for the second color is shifted to the thermal head 2*a* (Step S109). Subsequently, printing in the second color is performed in operations similar to those in the first color. Printing in the third and subsequent colors is performed by repeating these operations.

When printing in all colors is completed (Step S112), the recording sheet P is ejected (Step S114).

FIGS. 14A to 14F are plan views corresponding to FIGS. 12A to 12F, showing the orientations of the recording sheet in the operations. With reference to FIGS. 14A to 14F, a description will be given of the positioning operation before the orientation-changing operation and the layout condition of the orientation-changing rollers in a case in which the driving rollers 105*a* and 105*b* rotate in opposite directions at the same peripheral velocity. This is an example of the most easiest control method for the orientation-changing rollers 105. In the following description, the dimensions of the recording sheet do not correspond to dimensions of the recording sheet projected on a plane, but correspond to actual dimensions of the recording sheet in a curved state.

As described above with reference to FIG. 12C, the recording sheet is positioned in the positioning operation so that the distances D1 and D2 are equal to each other. FIG. 14C is a plan view showing the positioning state. When the orientation-changing rollers 105*a* and 105*b* rotate in opposite directions at the same peripheral velocity, the point around which the recording sheet is turned is the midpoint (a point P) between the orientation-changing rollers 105*a* and 105*b*. In order to convey the recording sheet in the longitudinal direction for image formation in the image forming unit 102, the longitudinal center line of the recording sheet after turning needs to substantially coincide with the center L of the image forming unit 102. On the assumption that the orientation-changing rollers 105*a* and 105*b* rotate in opposite directions at the same peripheral velocity and that the recording sheet is turned around the midpoint (point P) between the rollers 105*a* and 105*b*, it is necessary to satisfy the following two conditions in order for the center of the recording sheet after turning to substantially coincide with the center of the image forming unit 102.

The first condition is that the recording sheet is placed at such a position as that the orientation-changing rollers lie at almost the center of the recording sheet in the shorter dimension, that is, D1=D2. The positioning operation is performed to satisfy this condition. The second condition is that the orientation-changing rollers 105*a* and 105*b* are substantially symmetrical with respect to the center L of the image forming unit 102, that is, W1=W2. Therefore, the orientation-changing rollers 105*a* and 105*b* and the image forming unit 102 are arranged to satisfy this condition.

These two conditions are established when the orientation-changing rollers 105*a* and 105*b* rotate in opposite directions at the same peripheral velocity, and are not applied to a case in which the orientation-changing rollers 105*a* and 105*b* rotate in opposite directions at different peripheral velocities, since the center of turning does not coincide with the midpoint between the rollers 105*a* and 105*b* in this case. The conditions are not required as long as the turned recording sheet can be conveyed straight to the image forming unit 102 and can be properly positioned during image formation.

In the image forming apparatus of the second embodiment, the supplied recording sheet is turned approximately 90 degrees by the orientation-changing rollers, and is then subjected to image formation in the image forming unit, as described above. Therefore, the installation area of the image forming apparatus can be determined by the shorter dimension of the sheet storage unit, which is the smallest among the longer dimension of the sheet storage unit, the shorter dimension of the sheet storage unit, and the longer dimension of the image forming unit, and one of the other two dimensions. This considerably reduces the projection area of the image forming apparatus.

Compared with the related arts disclosed in Japanese Patent Laid-Open Nos. 5-162889 and 5-213487, the recording sheet changes its orientation in a smaller space without touching the sheet storage unit and other recording sheets stacked therein in the image forming apparatus of the second embodiment. This is because the recording sheet is turned after being completely drawn out of the sheet storage unit. Consequently, the size of the apparatus is reduced, and the operation reliability is enhanced. In addition, since the orientation is changed before the recording sheet is completely drawn out of the sheet storage unit in the related arts, it is impossible to shape the sheet storage unit like a box. Therefore, when the sheet storage unit is provided in the shape of a detachable cassette, recording sheets are not stably held, and easily fall off the cassette when the cassette is taken out of the apparatus. This reduces usability. In contrast, in the second embodiment, the orientation of the recording sheet is changed after the recording sheet is completely drawn out of the sheet storage unit. Therefore, the sheet storage unit can be shaped like a box. Even when the sheet storage unit in the form of a detachable cassette is taken out, recording sheets are stably held, and usability is enhanced.

As described above, the installation area of the image forming apparatus of the second embodiment is determined by the shorter dimension of the sheet storage unit, which is the smallest among the longer dimension of the sheet storage unit, the shorter dimension of the sheet storage unit, and the longer dimension of the image forming unit, and one of the other two dimensions. Therefore, the size of the image forming apparatus can be made much smaller than that of the known image forming apparatus whose installation area is determined by the two dimensions other than the shorter dimension of the sheet storage unit that is the smallest.

While the recording method is not specifically limited in the second embodiment, the advantages of the present invention can be provided regardless of the recording method. Therefore, the present invention is also applicable to various recording methods such as electrophotography, ink-jet printing, thermal printing, and thermal transfer printing.

Figure 15A:
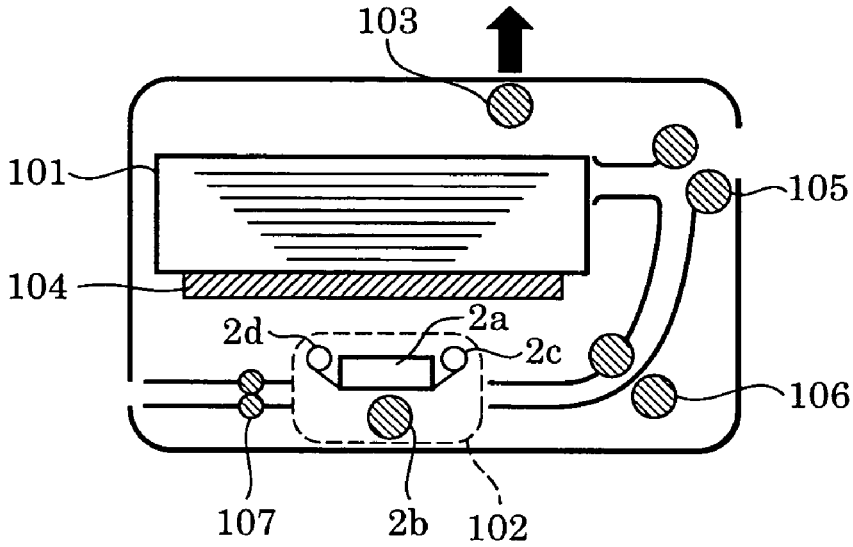
FIGS. 15A and 15B are explanatory views of an image forming apparatus according to a third embodiment of the present invention.
Figure 15B:
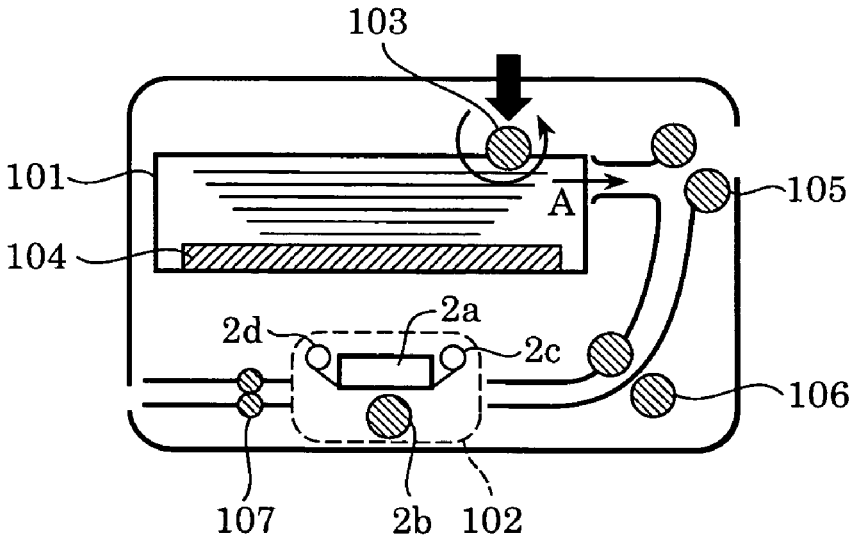

While recording sheets are supplied by the sheet supply roller provided on the lower side of the sheet storage unit in the second embodiment, similar advantages can be achieved when the sheet supply roller 103 is provided on the upper side of the sheet storage unit 101, as shown in FIGS. 15A and 15B.

There is no limitation to a method for supplying recording sheets into the sheet storage unit in the second embodiment. Recording sheets may be put in a detached sheet storage unit, or may be put in a fixed sheet storage unit while a cover of the sheet storage unit is open. In both cases, similar advantages can be achieved. The detaching and opening methods are not specifically limited.

The sheet separation method is not specifically limited. Similar advantages can be achieved, for example, regardless of whether separation is performed with a claw or a retard.

While the sheet storage unit is provided above the image forming unit in the second embodiment, similar advantages can be achieved regardless of how the units are arranged and the apparatus is oriented.

While the driving sections and the driven sections of the second and third feeding rollers are determined as in the figure, similar advantages can also be provided when the driving sections and the driven sections are in an inverse relation. The driven sections are not limited to rollers, and may be rigid or elastic members that are not rotatable, but are fixed as long as they can give a sufficient frictional force for feeding to the driving sections.

The stop of the operations described in the embodiment may be triggered under the open loop control determined by the number of rotations of the rollers, the closed loop control that detects the position of the recording sheet by a sensor, or a combination thereof. Although the closed loop control is more precise than the open loop control, and enhances the reliability of the apparatus, the mechanism and control tend to be complicated because the sensor and the like are necessary.

While the two pairs of rollers constitute the sheet-direction-changing mechanism in the above embodiment, some specific mechanisms of the sheet-direction-changing mechanism have been proposed hitherto. For example, Japanese Patent Laid-Open No. 2002-234636 discloses that a recording sheet is turned while the center of the recording sheet is clamped from the front and rear sides, and Japanese Patent Laid-Open No. 9-40230 discloses that a couple of forces are produced by a contact member that is in contact with feeding rollers and a recording sheet.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application Nos. 2004-085011 filed Mar. 23, 2004 and 2005-060650 filed Mar. 4, 2005, which is hereby incorporated by reference herein.

The invention claimed is:

1. An image forming apparatus comprising:

a storage means containing a recording sheet;

a supply member operable to supply the recording sheet from the storage means;

a feeding member operable to feed the recording sheet supplied by the supply member; and an image forming means operable to perform image formation on the recording sheet fed by the feeding member;

a direction-changing means operable to change the direction of the recording sheet supplied by the supply member so that the direction of short sides of the recording sheet becomes substantially parallel to the direction of long sides of the recording sheet being contained by the sheet storage means, wherein the supply member supplies the recording sheet on which image formation is possible in a supply direction parallel to short sides of the recording sheet, wherein the feeding member feeds the recording sheet in a feeding direction parallel to long sides of the recording sheet, wherein the image forming means performs image formation on the recording sheet that is being fed by the feeding member, wherein the image forming means performs image formation on the recording sheet after the direction of the recording sheet is changed by the direction-changing means, and wherein the direction-changing means includes a plurality of rollers, and performs a conveyance operation for conveying the recording sheet by rotating the rollers in the same direction, and a turning operation for turning the recording sheet around an axis perpendicular to the plane of the recording sheet by rotating the adjacent rollers in opposite directions.

2. The image forming apparatus according to claim 1, wherein the long sides of the recording sheet contained in the storage means is at an angle of approximately 90 degrees to the long sides of the recording sheet during image formation by the image forming means.

3. The image forming apparatus according to claim 1, wherein the feeding member feeds, during image formation by the image forming means, the recording sheet substantially parallel to the plane of the recording sheet that is contained in the storage means.

4. The image forming apparatus according to claim 1, further comprising:

a curved feeding path through which the recording sheet supplied by the supply member is guided to the image forming means, wherein the direction-changing means changes the orientation of the recording sheet by turning the recording sheet around an axis parallel to the normal direction of the curved feeding path.

5. The image forming apparatus according to claim 1, wherein the plurality of rollers comprises:

a first feeding roller operable to convey the recording sheet in a predetermined direction in contact with a first portion of the recording sheet; and a second feeding roller operable to convey the recording sheet in a direction different from the predetermined direction by acting on a second portion of the recording sheet.

6. The image forming apparatus according to claim 1, wherein the direction-changing means conveys the recording sheet supplied by the supply member in a first direction, and conveys the recording sheet in a second direction opposite to said first direction after the orientation is changed.

7. The image forming apparatus according to claim 6, further comprising:

a first recording-sheet feeding path through which the recording sheet is guided from the supply member to the direction-changing means; and a second recording-sheet feeding path though which the recording sheet conveyed in the second direction by the direction-changing means is guided to the image forming means.

8. The image forming apparatus according to claim 7, wherein the recording sheet is curved while being conveyed in the first direction by the direction-changing means, returns to an uncurved state after a trailing end of the recording sheet passes though the first recording-sheet feeding path, and is guided into the second recording-sheet feeding path by being conveyed in the second direction.

9. The image forming apparatus according to claim 1, wherein the direction-changing means changes the orientation after a trailing end of the recording sheet is completely drawn out from the storage means.

10. The image forming apparatus according to claim 1, wherein the plurality of rollers includes two pairs of rollers, and each of the pairs includes a driving roller to be driven by a motor, and a driven roller for nipping the recording sheet in cooperation with the driving roller.

11. The image forming apparatus according to claim 10, wherein the driving rollers are driven by different motors.

12. The image forming apparatus according to claim 1, wherein the feeding member includes a pair of feeding rollers that nip the recording sheet, and the feeding rollers are separate while the direction-changing means is changing the orientation of the recording sheet.

13. The image forming apparatus according to claim 1, wherein the supply member is moved into contact with and away from the recording sheet contained in the storage means.

14. The image forming apparatus according to claim 1, wherein the storage means includes a cassette that contains the recording sheet and is detachable from the image forming means.

15. The image forming apparatus according to claim 1, wherein the image forming means includes a thermal head having a heat generator in which a plurality of heating resistors are arranged linearly.

16. An image forming apparatus comprising:

a storage means containing a recording sheet;

a supply member operable to supply the recording sheet from the storage means;

a feeding member operable to feed the recording sheet supplied by the supply member; and an image forming means operable to perform image formation on the recording sheet fed by the feeding member;

a direction-changing means operable to change the direction of the recording sheet supplied by the supply member so that the direction of short sides of the recording sheet becomes substantially parallel to the direction of long sides of the recording sheet being contained by the sheet storage means, wherein the supply member supplies the largest recording sheet on which image formation is possible in a supply direction parallel to short sides of the recording sheet, wherein the feeding member feeds the largest recording sheet in a feeding direction parallel to long sides of the recording sheet, wherein the image forming means performs image formation on the recording sheet that is being fed by the feeding member, wherein the image forming means performs image formation on the recording sheet after the direction of the recording sheet is changed by the direction-changing means, and wherein the recording sheet is partly exposed outside a housing of the image forming apparatus while the orientation of the recording sheet is being changed by the direction-changing means.

17. An image forming apparatus comprising:

a storage means containing a recording sheet;

a supply member operable to supply the recording sheet from the storage means;

a feeding member operable to feed the recording sheet supplied by the supply member; and an image forming means operable to perform image formation on the recording sheet fed by the feeding member;

a direction-changing means operable to change the direction of the recording sheet supplied by the supply member so that the direction of short sides of the recording sheet becomes substantially parallel to the direction of long sides of the recording sheet being contained by the sheet storage means, wherein the supply member supplies the largest recording sheet on which image formation is possible in a supply direction parallel to short sides of the recording sheet, wherein the feeding member feeds the largest recording sheet in a feeding direction parallel to long sides of the recording sheet, wherein the image forming means performs image formation on the recording sheet that is being fed by the feeding member, wherein the image forming means performs image formation on the recording sheet after the direction of the recording sheet is changed by the direction-changing means, wherein the direction-changing means includes two pairs of rollers, and each of the pairs includes a driving roller to be driven by a motor, and a driven roller for nipping the recording sheet in cooperation with the driving roller, and wherein the driving roller and the driven roller are moved close to and away from each other.

18. An image forming apparatus comprising:

a storage means containing a recording sheet;

a supply member operable to supply the recording sheet from the storage means;

a feeding member operable to feed the recording sheet supplied by the supply member; and an image forming means operable to perform image formation on the recording sheet fed by the feeding member;

a regulating member operable to regulate the position of a side edge of the recording sheet fed by the feeding member, wherein the supply member supplies the largest recording sheet on which image formation is possible in a supply direction parallel to short sides of the recording sheet, wherein the feeding member feeds the largest recording sheet in a feeding direction parallel to long sides of the recording sheet, wherein the image forming means performs image formation on the recording sheet that is being fed by the feeding member, and wherein the feeding member includes an oblique feeding roller that feeds the recording sheet while pressing the recording sheet against the regulating member.

19. The image forming apparatus according to claim 18, further comprising:

direction-changing means operable to change the direction of the recording sheet supplied by the supply member so that the direction of short sides of the recording sheet becomes substantially parallel to the direction of long sides of the recording sheet being contained by the sheet storage means, wherein the feeding means feeds the recording sheet after the direction of the recording sheet is changed by the direction-changing means.

20. The image forming apparatus according to claim 19, wherein the direction-changing means comprises:

a first feeding roller operable to convey the recording sheet in a predetermined direction in contact with a first portion of the recording sheet; and a second feeding roller operable to convey the recording sheet in a direction different from the predetermined direction by acting on a second portion of the recording sheet.

21. The image forming apparatus according to claim 19, wherein the direction-changing means conveys the recording sheet supplied by the supply member in a first direction, and conveys the recording sheet in a second direction opposite to the first direction after the orientation is changed.

22. The image forming apparatus according to claim 18, wherein the storage means and the image forming means overlap in a vertical direction.

* * * * *